US005622146A

United States Patent [19]

Speil

[11] Patent Number: 5,622,146

[45] Date of Patent: Apr. 22, 1997

[54] FINGER LEVER FOR ACTUATING GAS EXCHANGE VALVES

[75] Inventor: Walter Speil, Ingolstadt, Germany

[73] Assignee: INA Walzlager Schaeffler KG, Germany

[21] Appl. No.: 564,084

[22] PCT Filed: May 19, 1994

[86] PCT No.: PCT/EP94/01617

§ 371 Date: Nov. 30, 1995

§ 102(e) Date: Nov. 30, 1995

[87] PCT Pub. No.: WO95/00750

PCT Pub. Date: Jan. 5, 1995

[30] Foreign Application Priority Data

Jun. 18, 1993 [DE] Germany ..... 43 20 195.4
Apr. 22, 1994 [DE] Germany ..... 44 14 028.2

[51] Int. Cl.[6] ..... F01L 1/18; F01L 1/24; F01L 1/26

[52] U.S. Cl. ..... 123/90.22; 123/90.4; 123/90.42; 123/90.43; 123/90.46; 74/559

[58] Field of Search ..... 123/90.22, 90.36, 123/90.39, 90.4, 90.41, 90.42, 90.43, 90.44, 90.45, 90.46; 74/519, 559

[56] References Cited

U.S. PATENT DOCUMENTS

| | | | |
|---|---|---|---|
| 4,589,383 | 5/1986 | Showalter | 123/90.36 |
| 4,800,851 | 1/1989 | Hertrich et al. | 123/90.46 |
| 4,825,822 | 5/1989 | Muranaka et al. | 123/90.42 |
| 4,913,104 | 4/1990 | Mills | 123/90.4 |
| 5,150,672 | 9/1992 | Fischer et al. | 123/90.22 |
| 5,365,894 | 11/1994 | Hackett | 123/90.22 |
| 5,503,121 | 4/1996 | Speil et al. | 123/90.22 |

FOREIGN PATENT DOCUMENTS

| | | |
|---|---|---|
| 0259106 | 3/1988 | European Pat. Off. . |
| 0583583 | 2/1994 | European Pat. Off. . |
| 2179700 | 3/1987 | United Kingdom . |

*Primary Examiner*—Weilun Lo
*Attorney, Agent, or Firm*—Bierman and Muserlian

[57] ABSTRACT

A finger lever (1) used together with a camshaft (10) for actuating gas exchange valves (6, 7) of an internal combustion engine, which finger lever for simultaneously actuating two gas exchange valves (6, 7) is configured as a forked finger lever (1) and is supported at one end on a support element (**2, 2*a*) and bears at an opposite end against an end of a shaft of a gas exchange valve (6, 7) the support element (2, 2*a*) comprising a device for compensating valve clearance, characterized in that a clearance compensation element is arranged on at least one of the ends of the forked finger lever (1) facing the ends of shafts of the gas exchange valves (6, 7**).

8 Claims, 4 Drawing Sheets

FINGER LEVER FOR ACTUATING GAS EXCHANGE VALVES

The invention concerns a finger lever for the actuation of gas exchange valves of an internal combustion engine.

STATE OF THE ART

A finger lever used in internal combustion engines for actuating a gas exchange valve is generally pivoted at one end on the cylinder head and bears at its opposite end against the end of the shaft of the gas exchange valve. The central region of the finger lever is contacted by a cam of a camshaft.

A finger lever of a generic type known from GB-A 21 79 700 is used together with a camshaft for actuating gas exchange valves of an internal combustion engine. For actuating two gas exchange valves simultaneously, the finger lever is configured as a forked finger lever which is supported at one end on a support element and bears at an opposite fork-shaped end against the ends of shafts of two gas exchange valves. The support element comprises a device for compensating valve clearance.

From EP-A-04 53 416, a valve drive comprising two oppositely oriented finger levers is known, each of which is supported at one end by a spherical cup mounting on a hydraulic clearance compensation element inserted into the cylinder head, while the opposite end of each finger lever bears against the end of a shaft of a gas exchange valve. A cam of a camshaft arranged off-center above the finger levers causes an oscillating movement of the finger levers which is then transmitted to the gas exchange valves. A disadvantage of this structure is that two separate finger levers and a broad cam are required.

A valve bridge assembly for the simultaneous actuation of two gas exchange valves known from U.S. Pat. No. 4,924,821, aims at avoiding an oblique force application on an actuating lever of the gas exchange valves. This bridge assembly comprises a central cup-shaped recess engaged by a guide element arranged on the actuating lever. A disadvantage of such bridge-type structures, however, is that, particularly in high-speed engines, the opening cycles of the two gas exchange valves do not correspond precisely enough to the calculated valve lifting curves. Thus there is the danger of undesired valve vibrations which, in the extreme case, can lead to uncontrolled abutments of the valve heads. This, in turn, results in higher wear of the valve seats and has a negative influence on the noise level.

OBJECT OF THE INVENTION

It is an object of the invention to assure a clearance-free actuation of the gas exchange valves in a multi-valve internal combustion engine as compactly as possible without disadvantageously increasing the mass of the forked finger lever.

THE INVENTION

The finger lever of the invention comprises a clearance compensation element on at least one of its fork ends facing the ends of the shafts of the gas exchange valves. The measure of arranging an insertion element in one of the fork ends of the finger lever of the invention makes it possible to effectively compensate a difference in dimension between the shaft ends of the gas exchange valves so that, advantageously, an inclined position of the finger lever and a resulting edge pressure on the cam-contacting surface are also avoided. This configuration of the invention guarantees an effective valve clearance compensation which advantageously compensates tolerances of the components of the gas exchange valves to be simultaneously actuated.

In an advantageous development of the invention according to Claim 2, an insertion element in the form of a hydraulic clearance compensation element is inserted into one fork end of the finger lever. The arrangement of a hydraulic insertion element in combination with a support element as provided by the invention results in a reliable valve drive with a long operating life and low noise development even when a compensation of a dimension difference at the shaft ends of the gas exchange valves is required due to manufacturing tolerances.

Another embodiment teaches the use of an insertion element having a reduced compensation stroke. The use of such an insertion element with a limited stroke of compensation is appropriate because it is required only to compensate the tolerance existing between the two gas exchange valves to be actuated simultaneously. It has been determined from experience that the required stroke of compensation is reduced to about ¼ of the stroke normally required for the compensation of all the tolerances. Moreover, the insertion element, which advantageously has a clearly smaller mass, improves the dynamic behaviour of the finger lever which is thus suitable also for use in internal combustion engines operating at high nominal speeds.

In a further embodiment an insertion element with a mechanical clearance compensation device, for example, an adjusting screw, which is less expensive, may be used as an alternative to a hydraulic clearance compensation element.

In a further development of the invention a lateral guidance for the finger lever is provided at the fork end in which no insertion element is inserted. According to the invention, this lateral guidance is effected by a longitudinal groove into which the end of the valve shaft engages thus assuring an exact guidance.

A lateral guidance of the arm of the finger lever fitted with a clearance compensation element is obtained in that this arm comprises two guiding cheeks pointing towards the end of the valve shaft. These guiding cheeks, which are advantageously arranged opposite each other in the form of projections in the region of the clearance compensation element, guarantee, in themselves or together with the previously described longitudinal groove in the arm of the finger lever, an effective lateral guidance.

Another embodiments provides for the arrangement of a roller in the cam-contacting region of finger lever, so that friction between the cam and the finger lever is advantageously reduced and the operating life of the finger lever prolonged.

According to another feature of the invention the oil supply to the insertion element in the finger lever is effected via the support element disposed in the cylinder head. A pressure medium is advantageously routed from the support element to the insertion element via a longitudinal bore made in the finger lever.

The support element comprises a manually adjustable clearance compensation element. Such an element, preferably comprising a differential screw is economic to manufacture and therefore has a cost advantage over an automatic hydraulic clearance compensation element.

Further features of the invention will become evident from the drawings and their description which illustrate some examples of embodiment of the invention:

Figure 1:
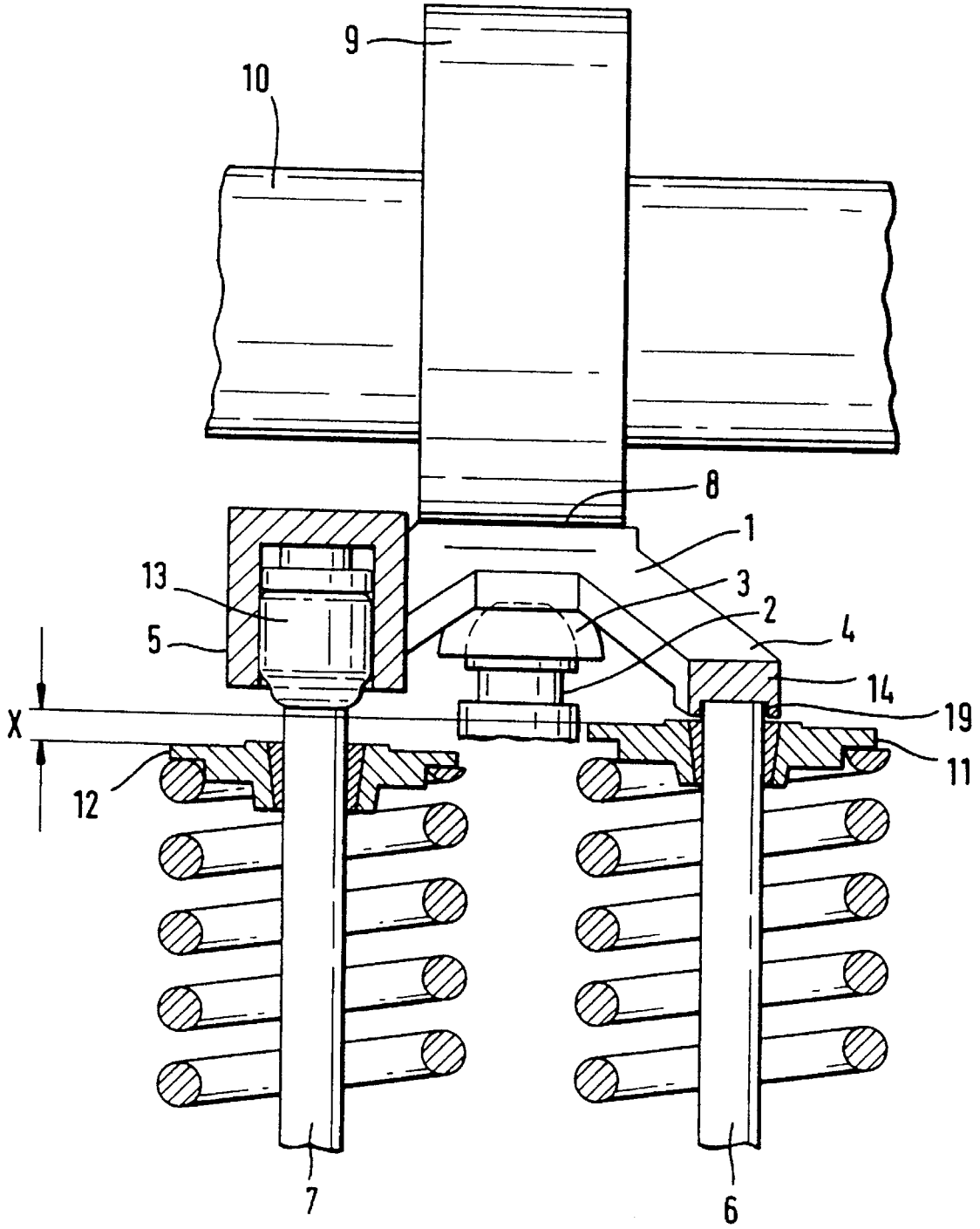
FIG. 1 shows a finger lever of the invention in the installed state, comprising a hydraulic insertion element.
Figure 2:
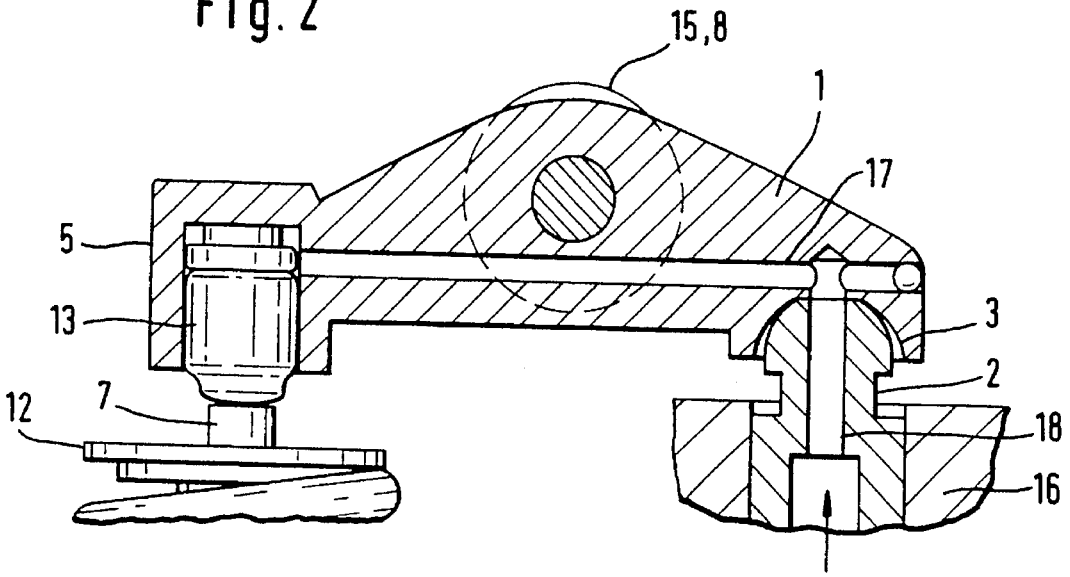
FIG. 2 is a side view of an alternative configuration of the finger lever of FIG. 1, comprising a roller in the region of cam contact.

FIG. 1 shows the finger lever 1 of the invention in the installed state in which it is supported by a spherical cup-shaped recess 3 at one end on a support element 2 which is inserted into the cylinder head 16 (see FIG. 2). At its end away from the support element 2, the finger lever comprises forked arms 4, 5 each of which bears against the end of a shaft of a gas exchange valve 6, 7. In the region of cam contact 8, the finger lever 1 is in force engagement with a cam 9 which is connected rotationally fast to a camshaft 10 which is rotatably mounted crosswise, that is to say, offset by 90° to the longitudinal axis of the finger lever 1. A difference in position of the ends of the shafts of the gas exchange valves 6, 7 due to tolerances is referenced at "X" and corresponds to the difference in height between the spring retainers 11, 12 which is compensated by an insertion element 13 inserted into the end of the arm 5 of the finger lever. FIG. 1 further shows a lateral guide 14 which is arranged on the end of the arm 4 and formed, for example, by an extension comprising a milled longitudinal groove 9 which extends parallel to the longitudinal direction of the finger lever 1 and engages the end of the shaft of the gas exchange valve 6.

The finger lever 1 shown in FIG. 2 comprises a roller 15 through which the finger lever 1 is in force engagement with the camshaft. The side view shows more clearly the positive engagement effected by the spherical cup-shaped recess 3 between the finger lever 1 and the support element 2 inserted into the cylinder head 16. A supply of oil to the insertion element 13 is effected by feeding oil through a tap bore 18 in the support element 2 which opens in the region of the cup-shaped recess 3 into a longitudinal bore 17 of the finger lever 1 leading to the insertion element 13.

Figure 3:
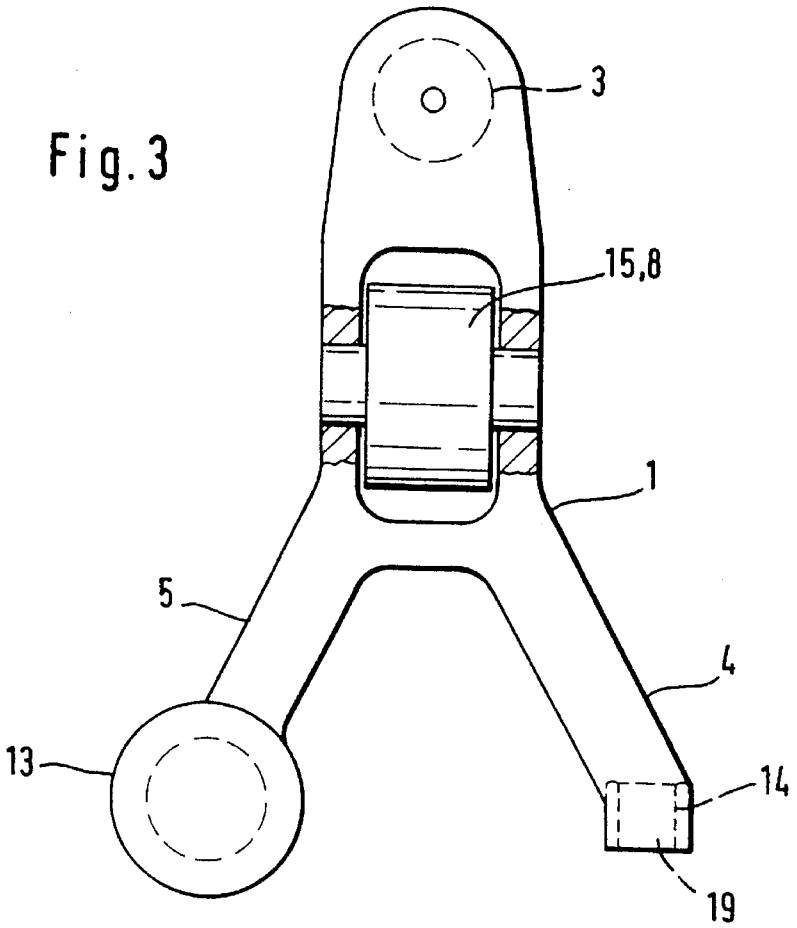
FIG. 3 is a top view of the finger lever of FIG. 2.

FIG. 3 is a top view of the finger lever 1, shown in a sectional view in FIG. 2, and serves to further elucidate the configuration and structure of this finger lever.

Figure 4:
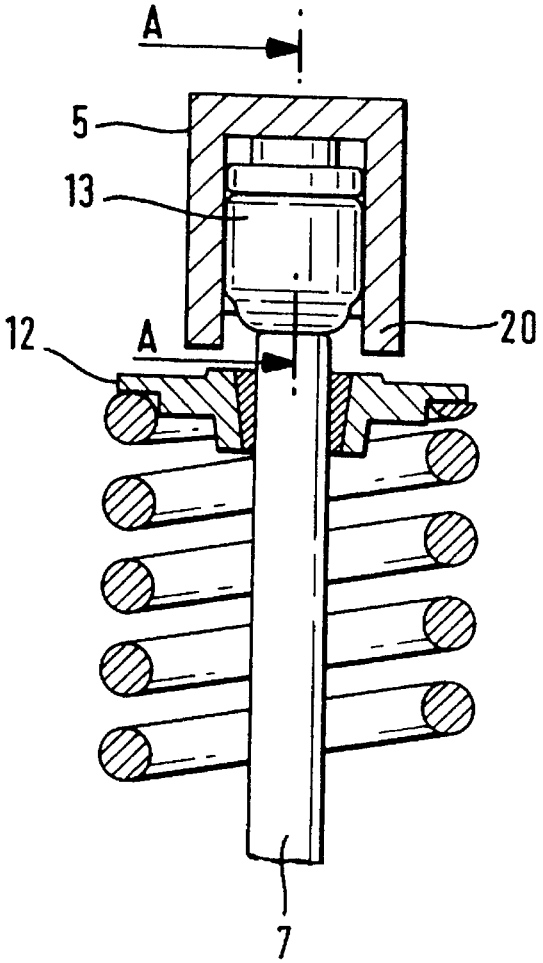
FIG. 4 is a detail of FIG. 1 showing the arm of the finger lever comprising a valve clearance compensation element and a lateral guide.
Figure 5:
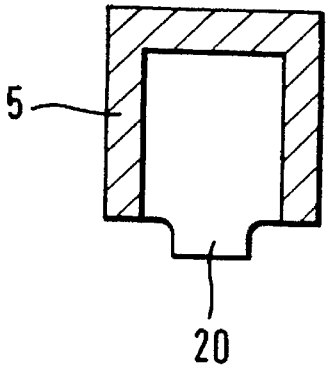
FIG. 5 is a sectional view of the arm of FIG. 4 along line A—A.

FIGS. 4 and 5 show an embodiment of the invention comprising an alternative to the lateral guide 14 of FIG. 1, wherein the arm 5 in which the insertion element 13 is arranged comprises guiding cheeks. As can be clearly seen in FIG. 4, these guiding flanges 20 are formed by opposite extensions of the outer wall of the arm 5 and extend beyond the end of the shaft of the gas exchange valve 7 thus providing an effective lateral guidance. FIG. 5 again clearly shows that the guiding cheeks are configured as projections from the outer wall of the arm 5. In a second example of embodiment of the finger lever of the invention (FIG. 6) parts identical to those of the first embodiment (FIG. 1) are designated by the same reference numerals so that reference may be made to the first example of embodiment for their description.

Figure 6:
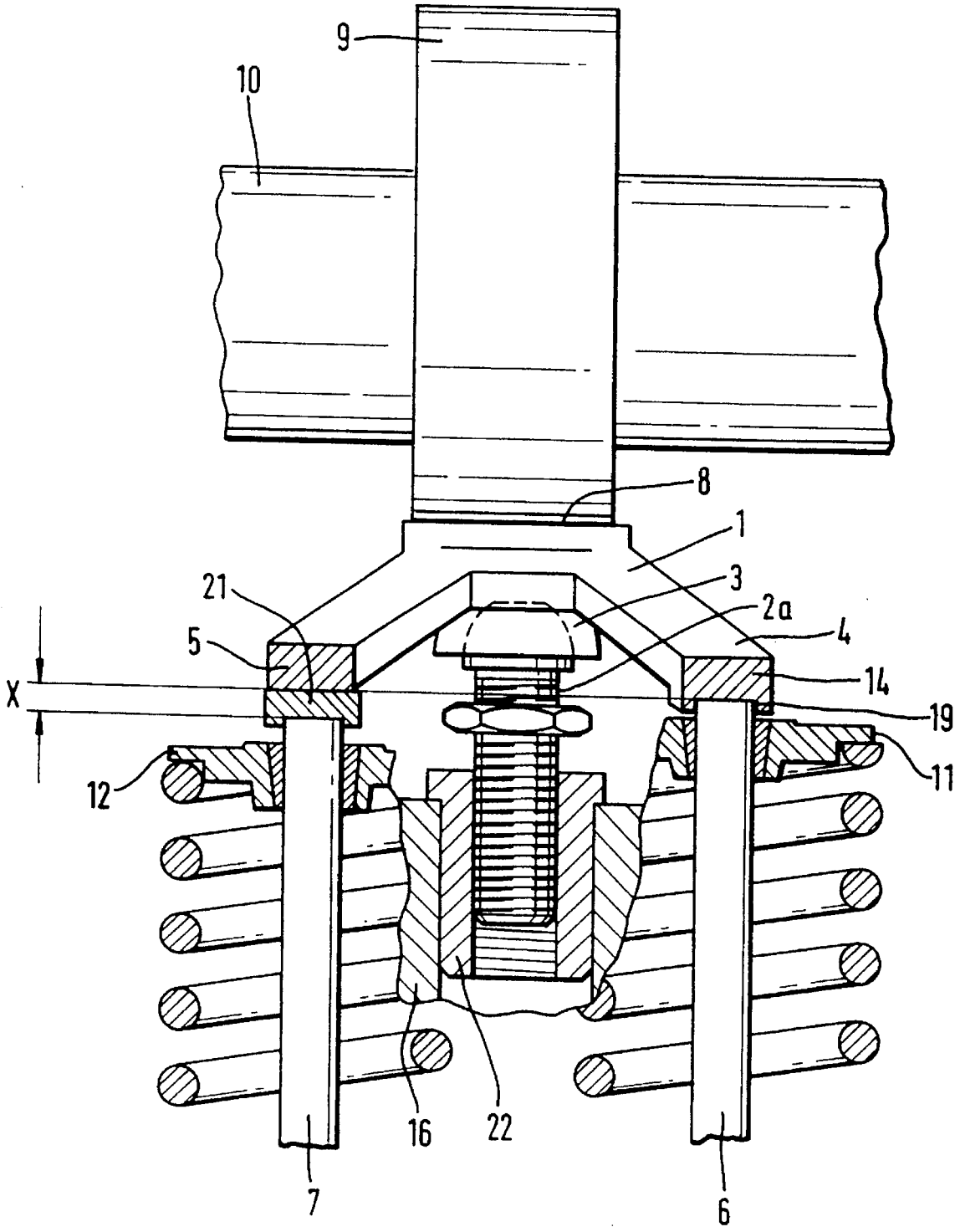
FIG. 6 is a forked finger lever similar to that of FIG. 1 but comprising a manually adjustable support element as well as, at one fork end, a manually adjustable clearance compensation device.

In the finger lever 1 of FIG. 6, there is arranged on the end of the arm 5, a mechanical or manually adjustable clearance compensation device 21 with which the difference in dimension "X" between the ends of the shafts of the gas exchange valves 6 and 7 can be compensated. The clearance compensation device 21 may also be in the form of washers of different thicknesses. The support element **2*a* in this embodiment is a manually adjustable screw, for example, a differential screw, whose end facing the finger lever 1 comprises a spherical cup-shaped recess 3 and whose other end is screwed into a threaded bush 22 inserted into the cylinder head 16**.

I claim:

1. A finger lever (1) used together with a camshaft (10) for actuating gas exchange valves (6, 7) of an internal combustion engine, which finger lever for simultaneously actuating two gas exchange valves (6, 7), is configured as a forked finger lever (1) and is supported at one end on a support element (2, **2*a*) and bears at an opposite end against an end of a shaft of a gas exchange valve (6, 7), the support element (2, 2*a*) comprising a device for compensating valve clearance, characterized in that a clearance compensation element is arranged on at least one of the ends of the forked finger lever (1) facing the ends of shafts of the gas exchange valves (6, 7**).

2. A finger lever of claim 1 wherein an insertion element (13) configured as a hydraulic clearance compensation element is inserted into one arm (5) of the forked finger lever (1) and has a compensation stroke which is limited to tolerance compensation of the two gas exchange valves (6, 7) to be simultaneously actuated.

3. A finger lever of claim 1 wherein a mechanical clearance compensation device (21) is inserted into one arm (5) of the forked finger lever (1).

4. A finger lever of claim 1 wherein a lateral guide (14) of the forked finger lever (1) comprises a longitudinal groove (19) which is made in one arm (4) thereof and engages an end of a shaft of the gas exchange valve (6).

5. A finger lever of claim 1 wherein the arm (5) of the forked finger lever (1) comprises guiding flanges (20) between which the end of the shaft of the gas exchange valve (7) is guided.

6. A finger lever of claim 1 wherein a cam-contacting region (8) of the forked finger lever (1) is formed by a roller (15) which is arranged in a recess of the forked finger lever (1) matched to an outer contour of the roller (15), and the roller is in force engagement with a cam of the camshaft.

7. A finger lever of claim 2 wherein a pressure medium supply to the hydraulic clearance compensation element is effected by a flow of pressure medium from the support element (2) into a longitudinal bore (17) of the forked finger lever (1) leading to the insertion element (13).

8. A finger lever according to the generic part of claim 1 wherein the support element (**2*a***) comprises a manually adjustable clearance compensation element.

* * * * *